United States Patent [19]

Nelsen

[11] Patent Number: 4,595,237

[45] Date of Patent: Jun. 17, 1986

[54] ACTUATING CONTROL FOR SEAT HEIGHT ADJUSTMENT MECHANISM

[75] Inventor: Randall P. Nelsen, Wyoming, Mich.

[73] Assignee: Haworth, Inc., Holland, Mich.

[21] Appl. No.: 609,399

[22] Filed: May 11, 1984

[51] Int. Cl.[4] ..... A47C 3/22

[52] U.S. Cl. ..... 297/347; 297/345; 297/183; 297/DIG. 3; 248/404

[58] Field of Search ..... 248/347, 580, 631, 404, 248/416; 297/183, 345, 347, DIG. 3; 16/112, 126

[56] References Cited

U.S. PATENT DOCUMENTS

| | | | |
|---|---|---|---|
| 339,587 | 4/1886 | Rush | 16/126 |
| 849,358 | 4/1907 | Barmore | 16/126 |
| 3,400,605 | 9/1968 | Hood | 74/501 |
| 3,788,587 | 1/1974 | Stemmler | 248/404 X |
| 4,139,175 | 2/1979 | Bauer | 297/347 X |
| 4,223,563 | 9/1980 | Kine | 74/501 R |
| 4,286,819 | 9/1981 | Inoue et al. | 297/379 X |
| 4,373,692 | 2/1983 | Knoblauch et al. | 297/347 X |
| 4,408,800 | 10/1983 | Knapp | 297/347 X |
| 4,507,821 | 4/1985 | Jorgensen | 16/126 |

FOREIGN PATENT DOCUMENTS

| | | | |
|---|---|---|---|
| 867761 | 9/1981 | U.S.S.R. | 74/501 R |

*Primary Examiner*—William E. Lyddane
*Assistant Examiner*—Laurie K. Cranmer
*Attorney, Agent, or Firm*—Flynn, Thiel, Boutell & Tanis

[57] ABSTRACT

A pedestal-type chair having a height-adjusting air spring connected between the base and seat assemblies, and a manually activated control for releasing the air spring. The control includes a small manually engageable activating lever pivotally supported interiorly of the seat assembly adjacent one side thereof and positioned so as to project slightly downwardly a small extent through the lower seat shell. This lever is connected to one end of an elongated flexible cable which extends interiorly of the seat assembly and has its other end connected to a force transfer lever positioned within the central interior of the seat assembly. This latter lever activates the valve-release member associated with the air spring.

7 Claims, 7 Drawing Figures

ACTUATING CONTROL FOR SEAT HEIGHT ADJUSTMENT MECHANISM

FIELD OF THE INVENTION

This invention relates to a fluid height-adjusting mechanism for a chair and, in particular, to an improved manually-activated control for the cylinder unit associated with the mechanism.

BACKGROUND OF THE INVENTION

Many commercial chairs, such as pedestal-type office chairs, utilize a fluid (more specifically a pneumatic) height-adjusting mechanism for permitting the height of the seat assembly to be adjusted to accommodate the user. These mechanisms typically employ a small telescopic pneumatic cylinder unit which extends between and has the opposite ends thereof coupled to the seat assembly and the chair base. The cylinder unit is a self-contained unit which normally remains in a locked condition but has a valve release pin projecting slidably from one end thereof so that depression of the valve release pin unlocks the cylinder unit and permits it to telescopically extend or contract. The cylinder unit, when the valve is released, is designed to cause upward movement of the seat assembly when the seat assembly is unoccupied or at least a significant portion of the user's weight is removed therefrom, whereas the cylinder unit will contract to lower the seat assembly when the latter has the user's weight imposed thereon and the valve is released. The valve release pin is normally positioned at the upper end of the cylinder unit directly adjacent and substantially within the lower central portion of the seat assembly, and a manually-activated control linkage extends therefrom to a position adjacent the peripheral edge of the seat assembly so as to be manually accessible by the user. Chairs of this general type, and specifically pneumatic cylinder units for height-adjusting mechanisms of the above-described type, are conventional and well known.

At the present time, the control linkage for depressing the valve release pin, in one commonly available form, comprises an elongated actuating lever which is positioned directly adjacent the underside of the seat assembly and has the inner end disposed for cooperation with the valve release pin. The activating lever projects outwardly and is provided with a knob on the outer free end. This knob is normally positioned under the seat assembly but in close proximity to the outer periphery of the seat adjacent one side thereof so as to be accessible by the chair occupant by reaching downwardly and thence inwardly to permit grasping of the knob. While this type of activating lever is functionally satisfactory, nevertheless this elongated lever is, at least in its majority, wholly visible since it is positioned below the bottom shell of the seat assembly. This type of control mechanism hence is aesthetically undesirable, and thus most chair manufacturers attempt to avoid use of such mechanisms on quality chairs.

To avoid use of exposed activating levers of the type described above, there has also been adopted and utilized a control linkage which is positioned substantially internally of the seat assembly so as to be virtually non-visible to the user of the chair, and hence improve the aesthetics thereof. This known linkage again typically employs an elongated rigid lever which extends from the valve release pin to a position disposed adjacent the periphery of the chair, although the lever is positioned interiorly of the seat assembly, such as by being disposed above the lower seat shell. The outer end of the lever is typically positioned directly over a small actuating button which is supported on and projects downwardly through the lower seat shell adjacent one side of the seat assembly. With this linkage, the user must extend his arm downwardly and thence sidewardly so that the fingers can engage the push button, whereupon the push button must be pushed upwardly to activate the lever, which in turn activates the valve release pin. While this mechanism is utilized in numerous chairs, it nevertheless possesses recognized disadvantages. For example, positioning of the linkage entirely within the interior of the seat assembly often creates space and mounting problems. Further, and more significantly, activation of the linkage by the user is somewhat difficult since the user must stretch his arm downwardly and then sidewardly beneath the seat assembly, and then engage the button with the fingers of the hand and press the button substantially vertically upwardly so as to activate the linkage. This overall position of the hand, and the requirement that the button then be pushed upwardly, hence results in a position which is less than optimum in terms of comfort and control as regards user activation.

Accordingly, it is an object of this invention to provide an improved manually-activated control for a fluid height-adjusting mechanism for a chair, which control is believed to significantly overcome and improve upon the disadvantages associated with known control linkages, as explained above.

Accordingly, this invention relates to an improved manually-activated control for a fluid height-adjusting mechanism, as aforesaid, which is believed to meet the needs of the chair user by providing more desirable access and ease of use, which hence simplifies the adjustability of the height function, and which is aesthetically complimentary to the chair.

A further object of the invention is to provide an improved control, as aforesaid, which can be activated by a natural outward rolling of the user's wrist, and can be activated with minimal force.

A still further object is to provide a control, as aforesaid, which employs a small cuplike control lever pivotally supported and positioned adjacent the outer periphery of the lower seat shell adjacent one side of the seat assembly, which control lever has a cup-shape which permits insertion of several fingers so that the lever can be readily pivoted downwardly and then outwardly toward one side of the seat assembly by a natural outward rolling movement of the user's wrist, which lever is coupled to one end of an elongated flexible element which at its other end is coupled to an interior lever which activates the valve release pin, whereby all of the control is hidden above the lower seat shell except for a small portion of the control lever.

Another object is to provide a control, as aforesaid, which can be manufactured and assembled easily and economically, which can be retrofitted to many existing chairs, which can be utilized comfortably and safely by the user, and which blends in and compliments the overall aesthetics of the chair.

In the present invention, there is provided a pedestal-type chair having a pneumatic height-adjusting mechanism connected between the base and seat assemblies. The seat assembly, as is substantially conventional, includes a cushion supported on an inner seat shell, an inner support frame positioned below the inner seat shell, which support frame normally comprises a part of a conventional chair control, and a lower seat shell which encloses the chair control. A conventional pneumatic cylinder unit (i.e., an air spring) is connected between the base and seat assemblies to permit adjustment in the height of the seat assembly. The air spring has telescopic upper and lower portions coupled to the base and seat assemblies, respectively. The air spring has a valve release pin which slidably projects axially from its upper end so as to be generally accessible from above the lower seat shell. A manually-activated control mechanism extends from the valve release pin internally of the seat assembly to a location disposed adjacent the periphery of the seat assembly to permit manual release of the cylinder unit when adjustment of the chair height is desired. This control mechanism includes a small manually-engageable activating lever which is pivotally supported interiorly of the seat assembly and positioned so as to project slightly downwardly a small extent through the lower seat shell adjacent one side of the seat assembly. This activating lever is pivotally supported for swinging movement about an axis which is positioned outermost and extends approximately parallel to one peripheral side of the seat assembly. The lever projects generally inwardly from the pivot axis toward the cylinder unit and defines a small cuplike recess which opens generally toward the cylinder unit, which recess is accessible directly adjacent and from below the lower seat shell so as to receive therein the ends of about three fingers. The lever has a small cable drum thereon in concentric relationship to the pivot axis, and one end of elongated flexible cable is anchored to this cable drum. An intermediate bell crank lever is pivotally supported on the interior support frame of the chair interiorly of the seat assembly in the lower central portion thereof. This bell crank has one lever arm thereof disposed for activating the valve release pin, and the other arm thereof is coupled to the other end of the cable, which cable is disposed interiorly of the seat assembly. To activate the valve release pin, the user positions the arm downwardly along the side of the chair seat and bends the arm inwardly so that the hand is positioned under the lower seat shell adjacent the periphery thereof. This hence enables the user to insert three fingers into the cuplike recess of the lever, and by placing the palm of the hand against the adjacent outer shell, the user can then roll his wrist outwardly to effect pivotal swinging movement of the activating lever downwardly and outwardly about its pivot axis. This effects a partial winding of the cable onto the cable drum, which in turn activates the bell crank lever so as to depress the valve release pin.

Other objects and purposes of the invention will be apparent to persons familiar with structures of this general type upon reading the following specification and inspecting the accompanying drawings.

Figure 1:
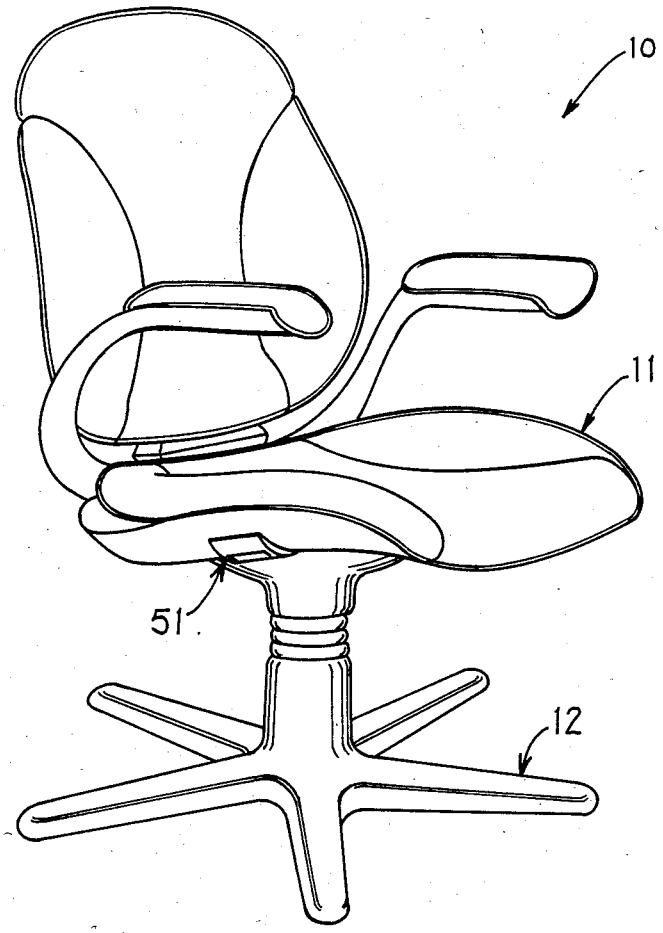
FIG. 1 is a perspective view of a pedestal-type chair employing a pneumatic height-adjusting mechanism and incorporating therein the improved actuating control of this invention.

Certain terminology will be used in the following description for convenience in reference only and will not be limiting. For example, the words "upwardly", "downwardly", "rightwardly" and "leftwardly" will refer to directions in the drawings to which reference is made. The words "upwardly" and "downwardly" will also refer to the directions of displacement of the seat assembly. The words "inwardly" and "outwardly" will refer to directions toward and away from, respectively, the geometric center of the chair or of the control mechanism, and of designated parts thereof. Said terminology will include the words specifically mentioned, derivatives thereof, and words of similar import.

DETAILED DESCRIPTION

Figure 2:
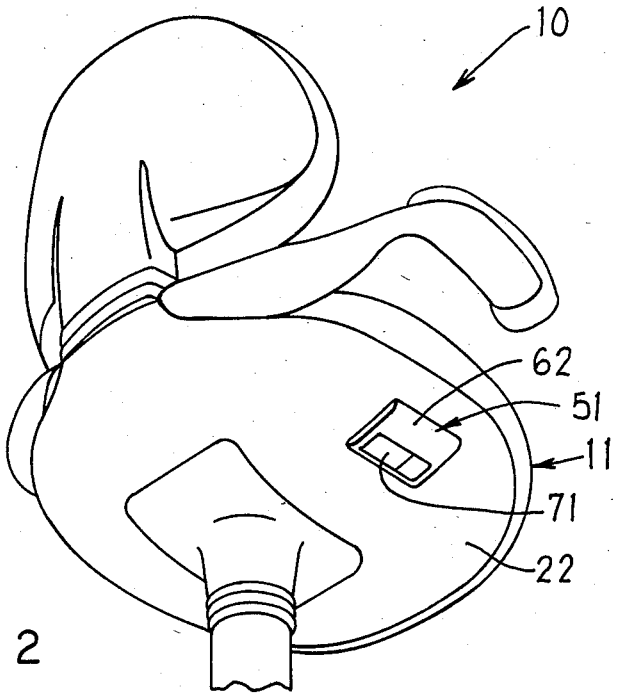
FIG. 2 is a fragmentary perspective view of the chair shown in FIG. 1 and illustrating the activating lever which is accessible from the underside of the lower seat shell.
Figure 3:
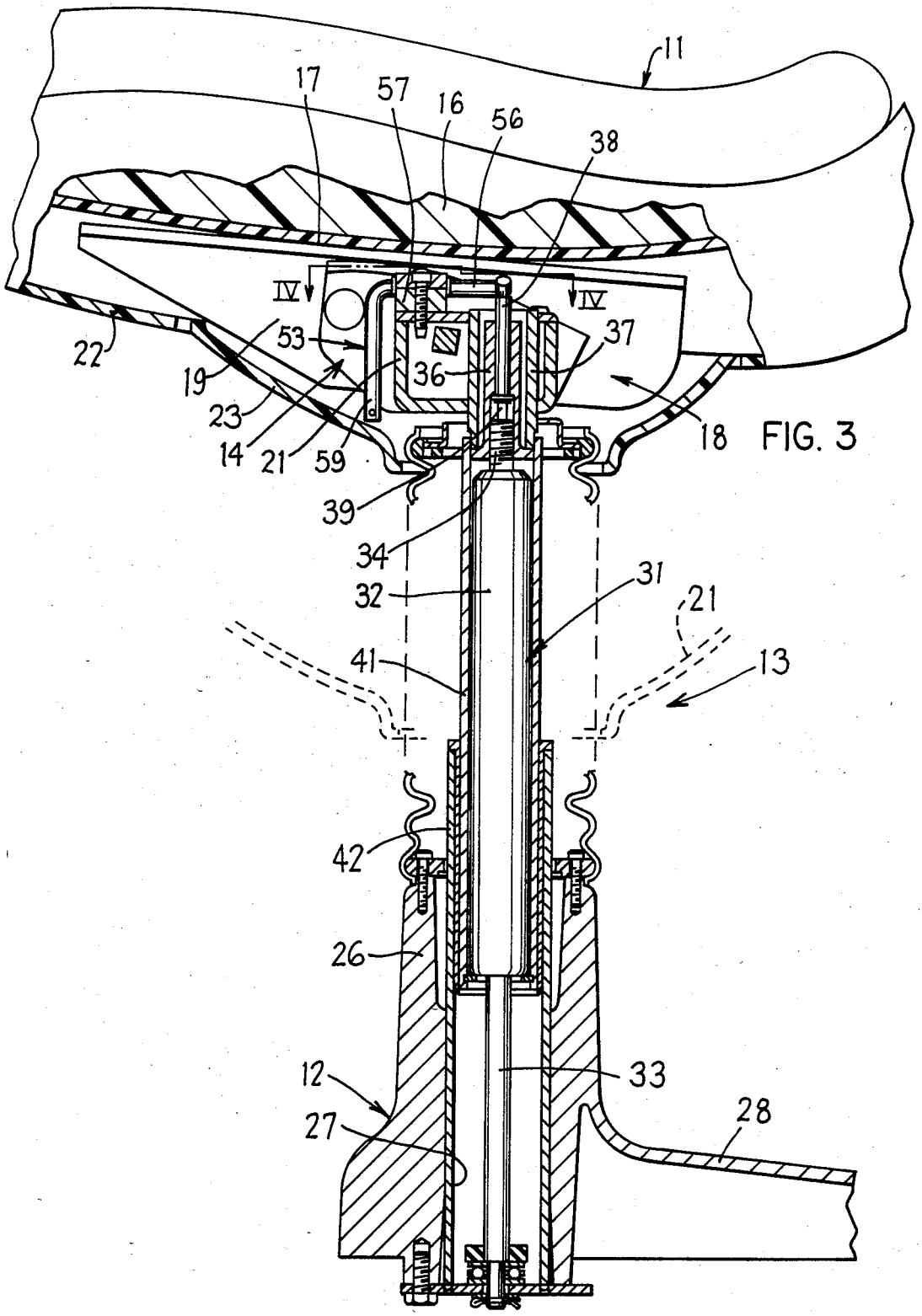
FIG. 3 is a fragmentary elevational view, partially in cross section, illustrating the pneumatic height-adjusting mechanism connected between the base and seat assemblies.
Figure 4:
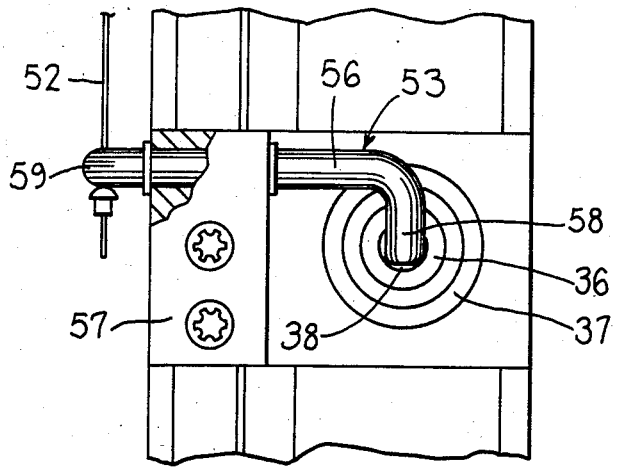
FIG. 4 is a fragmentary top view taken substantially along line IV—IV in FIG. 3.
Figure 5:
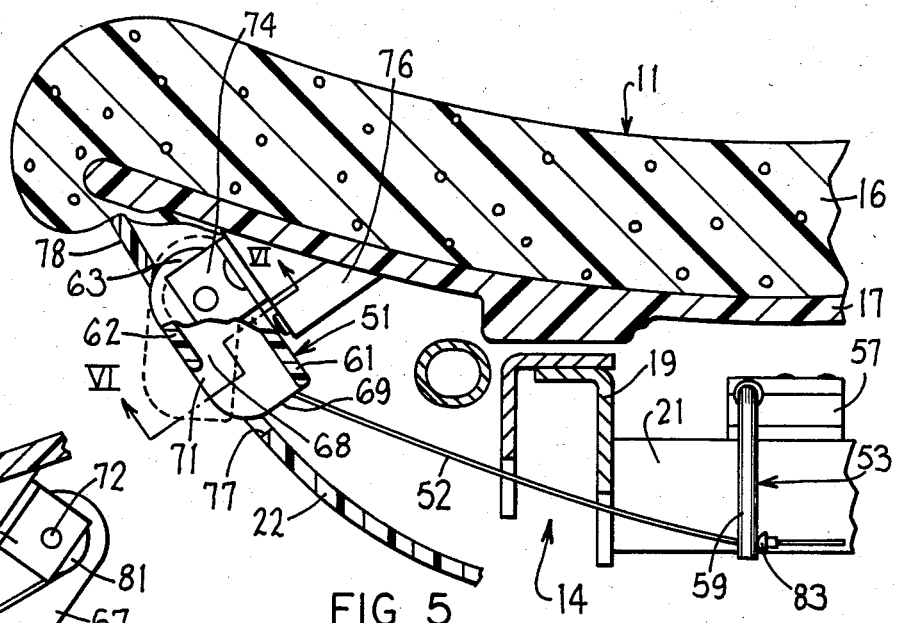
FIG. 5 is a fragmentary sectional view of the seat assembly and illustrating the improved actuating control.
Figure 7:
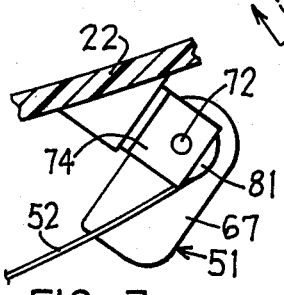
FIG. 7 is a fragmentary view which illustrates the opposite side of the activating lever from that illustrated in FIG. 5.
Figure 6:
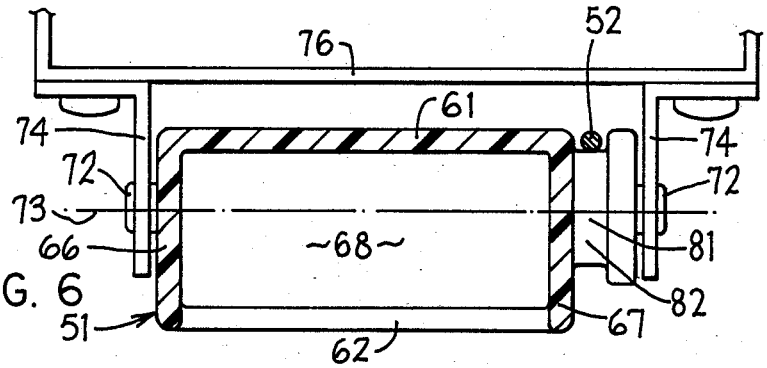
FIG. 6 is an enlarged, fragmentary sectional view taken substantially along line VI—VI in FIG. 5.

FIGS. 1–3 illustrate a swivel-type office chair 10 having a seat assembly 11 connected to and supported above a base assembly 12 by means of a height-adjusting mechanism 13, the latter being user-activated by an actuating control mechanism 14.

The seat assembly 11 is of known construction in that it includes a cushion 16 which overlies an inner seat shell or pan 17, the latter being supported on a conventional chair control 18. This chair control 18, in the illustrated embodiment, is of a conventional tilt-type for permitting tilting of the seat relative to the pedestal, although such chair controls may assume many different configurations, examples of such controls being illustrated by U.S. Pat. Nos. 4,067,610 and 4,219,233. Such control 18 conventionally provides an interior support frame for the inner seat shell, which support frame in the illustrated embodiment includes a pair of spaced side rails 19 rigidly joined together by a tubular frame element 21 extending therebetween. A suitable outer or bottom shell 22, which includes a central funnellike shroud 23, encloses the lower portion of the seat assembly 11.

The base assembly 12 is also conventional and includes a central hub 26 which projects upwardly and has a central opening 27 extending vertically therethrough. A plurality of legs 28, preferably five, are fixed to and extend radially outwardly from the central hub so that the base is of a conventional star-shape.

The height-adjusting mechanism 13 extends vertically between the base and seat assemblies for permitting the latter to be vertically adjusted, and this adjusting mechanism includes a fluid cylinder unit 31 connected between the seat and base assemblies to permit the height of the seat assembly 11 to be selectively varied as desired for optimum user comfort. This fluid cylinder unit 31 is normally of the pneumatic type and is conventionally referred to as an air spring. Such air spring units and their use as chair-height controls are conventional, and several such units are illustrated in U.S. Pat. Nos. 3,656,593, 3,837,704 and 4,257,582.

The air spring 31 includes respective upper and lower portions 32 and 33 which slidably telescope one within the other. The upper portion 32, in the illustrated embodiment, is defined by the cylinder housing portion of the air spring, and the lower portion 33 is defined by the piston rod portion. This piston rod portion 33 has its lower free end axially anchored with respect to the base assembly 12 in any conventional manner.

The upper or cylinder portion 32 has, in the illustrated embodiment, an upwardly projecting stub shaft 34 which is threadably engaged within a locator sleeve 36. This latter sleeve 36 slidably extends into a vertical tube 37 which is fixed to the support frame tube 21. The lower end of sleeve 36 has a flange which abuts the lower end of tube 37. This locator sleeve 36 confines but axially slidably supports therein an actuator pin 38 which projects upwardly and has the upper end thereof positioned outwardly from the locator sleeve for actuation by the control mechanism 14, as explained hereinafter.

The lower end of the actuator pin 38 is positioned substantially in abutting engagement with the upper free end of a control or valve release pin 39 which extends axially outwardly from the upper end of the air spring 31 and comprises an integral portion thereof. This valve release pin 39, when depressed, controls an internal valve within the air spring so that pressure can be released within the spring so as to unlock the spring and permit relative telescopic sliding movement between the upper and lower portions thereof. This structure of the air spring 31, and the release thereof by the pin 39, is conventional and well understood by those knowledgeable in this art, and is disclosed in the above-mentioned patents. It will also be recognized that the actuator pin 38 is coaxially aligned with and abuts the free end of the release pin 39, and hence the actuator pin 38 in effect constitutes an axial extension of the valve release pin 39.

The upper portion 32 of the air spring is axially anchored with respect to the internal frame structure associated with the seat assembly. This is accomplished in the illustrated embodiment by means of a support tube 41 which is fixed to the tube 37 and projects downwardly in surrounding relationship to the air spring, which support tube 41 has the upper air spring portion 32 axially anchored thereto. This upper support tube 41 in turn telescopically slides into a lower support tube 42 which is secured within the central opening 27 of the base hub 26. However, it will be recognized that numerous other support and connecting arrangements can be utilized and, in fact, are conventionally provided.

Further, the structure described above, and as illustrated in FIG. 3, is illustrated and described in copending application Ser. No. 580,053 filed Feb. 14, 1984, owned by the assignee of this application. The disclosure of said application Ser. No. 580,053 is incorporated herein by reference.

Considering now the improved actuating control mechanism 14 according to the present invention, and referring specifically to FIGS. 3–7, same includes an activating lever 51 which is positioned adjacent the lower seat shell 22 in the vicinity of one side of the seat assembly, which lever 51 is connected to one end of an elongated flexible activating cable 52. This latter cable in turn has the other end thereof connected to a driven lever 53 which is positioned in the lower central interior of the seat assembly for activation of the actuator pin 38.

The driven lever 53 is formed substantially as a bell crank and includes an intermediate rodlike pivot portion 56 which is pivotally supported by a bearing block 57 secured to the tube 21, which pivot rod 56 defines a pivot axis which extends substantially horizontally in the front-to-back direction of the chair. This pivot rod 56 has a first crank arm 58 secured thereto and projecting radially outwardly from one end thereof, which crank arm 58 adjacent its free end is disposed for abutting engagement with the upper end of the actuator pin 38. This crank arm 58 extends predominantly in a horizontal direction such that, when pivoted, the free end moves dominantly vertically and hence can effect depression of the actuator pin 38. The driven lever 53 has a further crank arm 59 which is fixed to and projects radially outwardly from the other end of the pivot rod 56. This crank arm 59 projects generally downwardly from the pivot rod, whereby the crank arm 59 hence extends substantially perpendicularly with respect to the crank arm 58.

Considering now the activating lever 51, this lever is preferably molded in one-piece of a plastics material. This lever includes substantially parallel top and bottom walls 61 and 62, respectively, which are integrally joined together at their outer end by means of an arcuate or substantially semicylindrical end wall 63. Opposed and substantially parallel sidewalls 66 and 67 extend between the top and bottom walls. All of these latter walls cooperate to define a pocketlike recess 68 within the lever, which recess opens outwardly through the end 69 thereof which is opposite the curved end wall 63. The bottom wall 62 also extends from the curved end wall 63 only approximately one-half the distance toward the other end 69, whereby the absence of the remainder of the bottom wall results in the defining of an access opening 71 between the sidewalls, which access opening is in open communication with the pocket-like recess 68.

The activating lever 51 also is provided with cylindrical support hubs 72 formed integrally thereon and projecting outwardly from the opposite sidewalls, which hubs 72 effectively define a pivot axis 73 which extends through the lever in the vicinity of the curved end wall. The pivot axis 73 hence extends through the recess 68 in the vicinity of the closed or blind end thereof.

The activating lever 51 is pivotally supported by a pair of bearing plates 74 which suitably pivotally support the hubs 72, which bearing plates in turn are secured to a support bracket 76. This latter bracket is attached to the underside of the inner shell or pan 17 in any conventional manner, such as by screws. The configuration and positioning of the bracket 76, and the mounting of the activating lever 51 thereon, is such that the activating lever 51 is positioned on the underside of the seat assembly in close proximity to one of the side edges of the seat assembly, with the lever 51 being disposed slightly forwardly from the center of the chair. The support of the lever 51 is such that a majority of the lever is disposed interiorly of the seat assembly, although the lower or outer seat shell 22 has a small and substantially rectangular opening 77 formed therein for permitting just the lower portion of the lever 51 to project therethrough. The lever 51 is positioned such that the bottom wall 62 thereof is oriented and hence substantially parallel with the contour of the adjacent portions of the bottom shell 22, and in fact the bottom wall 62 of the activating lever is disposed so as to project only slightly outwardly beyond the outer or lower surface of the bottom shell so as to permit the location of the lever to be easily determined by touch. The lever 51 is oriented such that the pivot axis 73 thereof is disposed outermost relative to the pedestal of the chair, which pivot axis extends dominantly in a horizontal direction, and dominantly in a direction which is from front-to-back. This hence results in the pocketlike recess 68 opening generally inwardly toward the center of the chair.

The lever 51, and specifically the opening 77, are spaced inwardly a sufficient distance from the peripheral edge of the bottom shell 22 so as to leave a significant surface area 78 on the bottom shell, the purpose of which surface area will be explained hereinafter.

The actuating cable 52 connects the activating lever 51 to the driven lever 53. For this purpose, the activating lever has a substantially cylindrical cable drum 81 formed integral therewith adjacent the sidewall 67, which cable drum is concentric with the pivot axis 73. This cable drum defines thereon a substantially cylindrical outer surface 82 which is adapted to have the actuating cable 52 partially wrapped therearound. One end of the actuating cable 52 is suitably anchored to the lever 51, and the other end of this actuating cable is anchored to the driven lever 53. More specifically, the inner end of the actuating cable 52 extends through an opening formed in the crank arm 59 adjacent the free end thereof, which cable has a suitable stop 83 secured thereto so as to abut the rear of the crank arm, and hence connect the cable and crank arm together. The cable 52 preferably comprises a single elongated flexible strand formed from either metal or appropriate synthetic materials.

OPERATION

While the operation of the invention is believed apparent from the above description, nevertheless same will be briefly summarized to ensure a proper understanding thereof.

The actuating control mechanism 14, and specifically the activating lever 51, will normally be maintained in the position illustrated in the drawings. In this position, the activating lever 51 protrudes only slightly below the outer seat shell 22, and the rest of the mechanism is entirely disposed interiorly of the seat assembly, whereby the mechanism does not detract from the desired aesthetics of the chair.

When the user of the chair desires to activate the height-adjusting mechanism, and assuming that the user wishes to lower the seat assembly and is seated on the cushion 16, then the user reaches his right arm downwardly past the right side of the seat assembly and positions his hand under the right front portion of the lower shell 22. The user can readily determine the location of the activating lever 51 by touch. The user then inserts several fingers, preferably three, through the access opening 71 into the recess 68, which recess 68 is sized so as to permit the fingers to be inserted up to approximately the first joint. This permits the user to obtain an adequate grasp on the lever. The user then rolls his wrist toward the outer side of the seat assembly, and this thus causes the activating lever 51 to freely pivot about the axis 73 in a downward and outward direction substantially as indicated by dotted lines in FIG. 5. If desired, the user can place the palm of his hand on the outer shell 22 in the vicinity of the surface area 78 so as to obtain additional leverage during the rolling movement of the wrist. As the activating lever 51 rotates downwardly, this hence causes the activating cable 52 to be partially wrapped around the drum 81, which in turn pivots the crank arm 59 sidewardly (leftwardly in FIG. 5), and this likewise causes a corresponding downward pivoting of the other crank arm 58. This hence depresses the actuator pin 38 and valve release pin 39 so as to unlock the air spring 31.

With the air spring unlocked, assuming the user is sitting in the chair, then the user's weight is sufficient to overcome the internal force of the spring, and hence the air spring will permit the seat assembly to lower. Of course, as soon as the user manually releases the activating lever 51, the internal forces of the air spring 31 will push the pins 38 and 39 upwardly so as to reclose the internal valve and hence lock up the cylinder, and this in turn will reversely rotate the driven lever 53 which, acting through the cable 52, will return the activating lever 51 to its normal upward position.

If raising of the seat assembly is desired, then the activation of the mechanism 14 and air spring 31 is exactly the same except, in this instance, the user either is not seated on the chair, or the user leans forward to significantly remove his weight off the seat assembly, whereupon the internal force of the air spring is sufficient to lift the seat assembly.

The present invention hence provides a manual control (that is, the lever 51) which can be conveniently located for ease of use, which can be readily operated in both a seated (for lowering) or semistanding position (for raising), which can be easily located by touch, which can be actuated with a natural motion of the user, and which does not require excessive force for actuation.

While the illustrated embodiment discloses an air spring positioned with the piston rod portion lowermost, it will be recognized that some commercially available air springs have internal valves which operate somewhat reversely, and hence the piston rod portion is then disposed uppermost, and the valve release pin 39 projects axially outwardly from the free end of the piston rod. The use of these various conventional air springs is fully contemplated and encompassed within the arrangement of the present invention.

The control of this invention, due to the type of wrist motion involved, is believed to provide increased sensitivity and hence more precise control over the closing of the cylinder and holding of the chair seat at the desired elevation.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a pedestal-type chair having base and seat assemblies, the seat assembly including inner and bottom shells defining a substantially closed interior space therebetween, a frame structure positioned in said space, and a height-adjusting mechanism extending vertically and connected between said base and seat assemblies, the height-adjusting mechanism including a fluid pressure cylinder unit having telescopic upper and lower sections connected to the seat and base assemblies, respectively, said upper section having the upper end thereof positioned substantially within the seat assembly at the lower central portion of the interior thereof and being provided with an upwardly projecting valve release member which is slidably supported on and projects axially inwardly of the cylinder unit, and a manually actuated control mechanism for movably displacing the valve release member to unlock the cylinder unit when height adjustment of the seat assembly is desired, the improvement wherein said control mechanism comprises:

said bottom shell having a small opening therethrough adjacent but spaced inwardly a small distance from an outer edge thereof, said opening communicating with said interior space;

a manually engageable activating lever pivotally supported on said seat assembly within said interior space, said activating lever being positioned closely adjacent the bottom seat shell in the vicinity of said outer edge thereof and accessible solely from beneath the seat assembly;

means pivotally supporting said activating lever relative to said seat assembly and defining a pivot axis for said activating lever which is positioned in the vicinity of said outer edge;

said activating lever being normally maintained in an inactive position wherein at least a majority of the activating lever and its pivot axis are positioned interiorly of the seat assembly above the bottom shell, said activating lever having a grip portion which projects radially from said pivot axis, said grip portion extending approximately across said opening when said activating lever is in said inactive position so as to be accessible from beneath the bottom shell;

said activating lever having a drumlike portion fixed thereto in concentric relationship with said pivot axis, said drumlike portion being positioned within said interior space;

a motion-transfer lever positioned interiorly of said seat assembly within a central part of said interior space and pivotally supported relative to said interior frame structure, said motion-transfer lever having a portion thereof engaged with said valve release member for activating the latter; and elongated flexible cable means positioned interiorly of said seat assembly and connected between said motion-transfer lever and said activating lever for transferring the motion of the activating lever to the motion-trasnfer lever so as to activate the valve release member when height adjustment is desired, said cable means being adapted to at least partially wrap around said drumlike portion in response to swinging of the activating lever into an activated position.

2. A chair according to claim 1, wherein said pivot axis is disposed adjacent an outer end of said activating lever so that the pivot axis is disposed in close proximity to an outer edge of the opening formed in said bottom shell, said activating lever projecting generally inwardly from said pivot axis toward the central region of the chair seat when the activating lever is in said inactive position, said bottom shell having a small region which is formed between the opening therethrough and the adjacent outer edge for permitting engagement with the hand of the chair occupant, said activating lever defining therein a pocketlike recess which projects radially outwardly from said pivot axis and is defined between opposed upper and lower walls which are joined together by opposed side walls, said lower wall being positioned in close proximity with the bottom shell when the activating lever is in said inactive position, said lower wall having an access opening therethrough adjacent the radially outer end of the activating lever, said access opening being substantially aligned with the opening through the bottom shell when the activating lever is in said inactive position so that the occupant's fingers can be inserted upwardly through the bottom shell opening and the access opening into the recess for gripping the activating lever, said activating lever being pivotally swung downwardly and outwardly about said pivot axis into said activated position wherein the activating lever projects downwardly through the bottom shell opening, whereby the occupant can position the palm of a hand against the small region of the bottom shell adjacent the opening therethrough so that the occupant's fingers can be inserted through the bottom shell opening and access opening into the recess so as to grip the activating lever and then swing it downwardly about the pivot axis through the bottom shell opening to effect tensioning of the cable means and activation of the motion-transfer lever.

3. A chair according to claim 1, wherein said pivot axis extends dominantly in a horizontal direction, and is disposed adjacent one side edge of the seat assembly so as to extend dominantly in a direction which is from front-to-back of the seat assembly, and said opening in said bottom shell being disposed adjacent said one side edge of said seat assembly, whereby the activating lever is accessible due to the occupant moving a hand downwardly past said one side edge of the seat assembly and then inwardly under the bottom shell for access to the activating lever.

4. A chair according to claim 3, wherein the motion-transfer lever is pivotally supported for swinging movement about a second pivot axis which extends dominantly in a horizontal direction which is also dominantly in the front-to-back direction of the seat assembly, said motion-transfer lever having a first arm which projects generally downwardly from said second pivot axis and is coupled to said cable means adjacent the free end thereof, said motion-transfer lever having a second arm which projects generally horizontally from said second pivot axis in a direction toward the other side of said seat assembly so that said second arm abuttingly contacts the upper end of said valve release member.

5. In a pedestal-type chair having base and seat assemblies, the seat assembly including inner and bottom shells with a frame structure positioned interiorly therebetween, and a height-adjusting mechanism extending vertically and connected between said base and seat assemblies, the height-adjusting mechanism including a fluid pressure cylinder unit having telescopic upper and lower sections connected to the seat and base assemblies, respectively, said upper section having the upper end thereof positioned substantially within the seat assembly at the lower central portion of the interior thereof and being provided with an upwardly projecting valve release member which is slidably supported on and projects axially inwardly of the cylinder unit, and a manually actuated control mechanism for movably displacing the valve release member to unlock the cylinder unit when height adjustment of the seat assembly is desired, the improvement wherein said control mechanism comprises:

a manually engageable activating lever pivotally supported on said seat assembly and positioned in close proximity to an outer edge of the seat assembly, said activating lever being positioned closely adjacent the bottom seat shell in the vicinity of an outer edge thereof and accessible from beneath the seat assembly;

means pivotally supporting said activating lever relative to said seat assembly and defining a pivot axis for said activating lever which is positioned in the vicinity of said outer edge;

said activating lever comprising a one-piece structure having substantially parallel top and bottom walls joined together by opposed side walls so as to resemble a tubular structure, said tubular structure being closed by an end wall at one end thereof, said pivot axis being positioned in close proximity to said end wall, said tubular structure projecting radially from said pivot axis and defining a pocketlike recess which opens outwardly through the other end of said tubular structure, said tubular structure and said pooketlike recess projecting radially from said pivot axis in a direction generally toward the center portion of the seat assembly, said activating lever being of short radial extent, and the pivot axis for said activating lever being disposed between the free end of the lever and the adjacent outer edge of the seat assembly;

said activating lever being disposed so that said pivot axis and at least a majority of the activating lever is positioned interiorly of the seat assembly above said bottom shell, said bottom shell having a small opening extending therethrough in the vicinity of said outer edge, said activating lever being normally maintained in an inactive position whereby the bottom wall of said lever is disposed approximately coextensively with the bottom shell, said pocketlike recess being accessible from beneath the bottom shell when in said inactive position;

a motion-transfer lever positioned interiorly of said seat assembly within the central interior region thereof and pivotally supported relative to said interior frame structure, said motion-transfer lever having a portion thereof engaged with said valve release member for activating the latter; and elongated flexible cable means positioned interiorly of said seat assembly and connected between said motion-transfer lever and said activating lever for transferring the motion of the activating lever to the motion-transfer lever so as to activate the valve release member when height adjustment is desired.

6. A chair according to claim 5, wherein the one-piece structure defining said activating lever has a drumlike portion fixedly associated therewith in concentric relation with said pivot axis, said drumlike portion being fixed to an outer side of one of said opposed side walls so that the drumlike portion is spaced sidewardly from the pocketlike recess defined within said tubular structure, said cable means being adapted to at least partially wrap around said drumlike portion in response to swinging of the activating lever into an activated position.

7. A chair according to claim 6, wherein said tubular structure and said drumlike portion are integrally formed in one piece of a plastics material and additionally include hub portions which project coaxially outwardly in opposite directions from the opposed side walls for defining said pivot axis.

* * * * *